US007892005B2

(12) United States Patent
Haube

(10) Patent No.: US 7,892,005 B2
(45) Date of Patent: Feb. 22, 2011

(54) CLICK-TIGHT COAXIAL CABLE CONTINUITY CONNECTOR

(75) Inventor: Richard A. Haube, Cazenovia, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 12/783,131

(22) Filed: May 19, 2010

(65) Prior Publication Data

US 2010/0297871 A1 Nov. 25, 2010

Related U.S. Application Data

(60) Provisional application No. 61/179,505, filed on May 19, 2009.

(51) Int. Cl.
*H01R 4/38* (2006.01)

(52) U.S. Cl. ..... 439/321; 439/315; 439/578

(58) Field of Classification Search ..... 439/315, 439/320, 321, 489, 578
See application file for complete search history.

(56) References Cited

U.S. PATENT DOCUMENTS

| | | | |
|---|---|---|---|
| 1,667,485 | A | 4/1928 | MacDonald |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |

(Continued)

FOREIGN PATENT DOCUMENTS

CA 2096710 A1 11/1994

(Continued)

OTHER PUBLICATIONS

U.S. Appl. No. 12/472,368, filed May 25, 2009.

(Continued)

*Primary Examiner*—Tho D Ta
(74) *Attorney, Agent, or Firm*—Schmeiser, Olsen & Watts, LLP

(57) ABSTRACT

A click-tight coaxial cable continuity connector is provided comprising a connector body, a post engageable with connector body, the post including a flange having a plurality of spaced-apart surface features. A nut is rotatably movable with respect to the post, wherein the nut includes an internal lip having a plurality of spaced-apart surface features, wherein the plurality of spaced-apart surface features of the nut are dimensioned to oppositely correspond in size, number and location to the plurality of spaced-apart surface features of the post. A click-tight continuity member is structurally configured to operably correspond with the dimensions of the plurality of spaced-apart surface features of the nut and also the spaced apart surface features of the post, the click-tight continuity member residing between the nut and the post. When the nut is rotated with respect to the post, the click-tight continuity member affords intermittent rotational resistance upon the nut, via structurally-induced compression forces resultant when the plurality of spaced-apart surface features of the nut are not oppositely correspondingly aligned with the plurality of spaced-apart surface features of the post.

20 Claims, 7 Drawing Sheets

U.S. PATENT DOCUMENTS

| | | | |
|---|---|---|---|
| 2,870,420 | A | 1/1959 | Malek |
| 3,001,169 | A | 9/1961 | Blonder |
| 3,091,748 | A | 5/1963 | Takes et al. |
| 3,094,364 | A | 6/1963 | Lingg |
| 3,184,706 | A | 5/1965 | Atkins |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,710,005 | A | 1/1973 | French |
| 3,739,076 | A | 6/1973 | Schwartz |
| 3,744,007 | A | 7/1973 | Horak |
| 3,778,535 | A | 12/1973 | Forney, Jr. |
| 3,781,762 | A | 12/1973 | Quackenbush |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,030,798 | A * | 6/1977 | Paoli ..... 439/321 |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,296,986 | A | 10/1981 | Herrmann et al. |
| 4,307,926 | A | 12/1981 | Smith |
| 4,322,121 | A | 3/1982 | Riches et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,470,657 | A | 9/1984 | Deacon |
| 4,484,792 | A | 11/1984 | Tengler et al. |
| 4,484,796 | A | 11/1984 | Sato et al. |
| 4,506,943 | A | 3/1985 | Drogo |
| 4,515,427 | A | 5/1985 | Smit |
| 4,525,017 | A | 6/1985 | Schildkraut et al. |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |

4,634,213 A 1/1987 Larsson et al.
4,640,572 A 2/1987 Conlon
4,645,281 A 2/1987 Burger
4,650,228 A 3/1987 McMills et al.
4,655,159 A 4/1987 McMills
4,660,921 A 4/1987 Hauver
4,668,043 A 5/1987 Saba et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,691,976 A 9/1987 Cowen
4,703,987 A 11/1987 Gallusser et al.
4,703,988 A 11/1987 Raux et al.
4,717,355 A 1/1988 Mattis
4,734,050 A 3/1988 Negre et al.
4,734,666 A 3/1988 Ohya et al.
4,737,123 A 4/1988 Paler et al.
4,738,009 A 4/1988 Down et al.
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,806,116 A 2/1989 Ackerman
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,154,636 A 10/1992 Vaccaro et al.
5,161,993 A 11/1992 Leibfried, Jr.
5,166,477 A 11/1992 Perin, Jr. et al.
5,181,161 A 1/1993 Hirose et al.
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,227,587 A 7/1993 Paterek
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawagauchi et al.
5,393,244 A 2/1995 Szegda
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday

| | | | |
|---|---|---|---|
| 5,683,263 | A | 11/1997 | Hse |
| 5,702,263 | A | 12/1997 | Baumann et al. |
| 5,722,856 | A | 3/1998 | Fuchs et al. |
| 5,746,617 | A | 5/1998 | Porter, Jr. et al. |
| 5,746,619 | A | 5/1998 | Harting et al. |
| 5,769,652 | A | 6/1998 | Wider |
| 5,775,927 | A | 7/1998 | Wider |
| 5,863,220 | A | 1/1999 | Holliday |
| 5,877,452 | A | 3/1999 | McConnell |
| 5,879,191 | A | 3/1999 | Burris |
| 5,882,226 | A | 3/1999 | Bell et al. |
| 5,921,793 | A | 7/1999 | Phillips |
| 5,938,465 | A | 8/1999 | Fox, Sr. |
| 5,944,548 | A | 8/1999 | Saito |
| 5,957,716 | A | 9/1999 | Buckley et al. |
| 5,967,852 | A | 10/1999 | Follingstad et al. |
| 5,975,949 | A | 11/1999 | Holliday et al. |
| 5,975,951 | A | 11/1999 | Burris et al. |
| 5,997,350 | A | 12/1999 | Burris et al. |
| 6,010,349 | A | 1/2000 | Porter, Jr. |
| 6,019,635 | A | 2/2000 | Nelson |
| 6,022,237 | A | 2/2000 | Esh |
| 6,032,358 | A | 3/2000 | Wild |
| 6,042,422 | A | 3/2000 | Youtsey |
| 6,053,777 | A | 4/2000 | Boyle |
| 6,089,903 | A | 7/2000 | Stafford Gray et al. |
| 6,089,912 | A | 7/2000 | Tallis et al. |
| 6,089,913 | A | 7/2000 | Holliday |
| 6,146,197 | A | 11/2000 | Holliday et al. |
| 6,152,753 | A | 11/2000 | Johnson et al. |
| 6,153,830 | A | 11/2000 | Montena |
| 6,210,222 | B1 | 4/2001 | Langham et al. |
| 6,217,383 | B1 | 4/2001 | Holland et al. |
| 6,239,359 | B1 | 5/2001 | Lilienthal, II et al. |
| 6,241,553 | B1 | 6/2001 | Hsia |
| 6,261,126 | B1 | 7/2001 | Stirling |
| 6,271,464 | B1 | 8/2001 | Cunningham |
| 6,331,123 | B1 | 12/2001 | Rodrigues |
| 6,332,815 | B1 | 12/2001 | Bruce |
| 6,358,077 | B1 | 3/2002 | Young |
| D458,904 | S | 6/2002 | Montena |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| D462,327 | S | 9/2002 | Montena |
| 6,468,100 | B1 | 10/2002 | Meyer et al. |
| 6,491,546 | B1 | 12/2002 | Perry |
| D468,696 | S | 1/2003 | Montena |
| 6,506,083 | B1 | 1/2003 | Bickford et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,676,446 | B2 | 1/2004 | Montena |
| 6,683,253 | B1 | 1/2004 | Lee |
| 6,692,285 | B2 | 2/2004 | Islam |
| 6,712,631 | B1 | 3/2004 | Youtsey |
| 6,716,062 | B1 | 4/2004 | Palinkas et al. |
| 6,733,337 | B2 | 5/2004 | Kodaira |
| 6,767,248 | B1 | 7/2004 | Hung |
| 6,786,767 | B1 | 9/2004 | Fuks et al. |
| 6,790,081 | B2 | 9/2004 | Burris et al. |
| 6,805,584 | B1 | 10/2004 | Chen |
| 6,817,896 | B2 | 11/2004 | Derenthal |
| 6,848,939 | B2 | 2/2005 | Stirling |
| 6,848,940 | B2 | 2/2005 | Montena |
| 6,884,115 | B2 | 4/2005 | Malloy |
| 6,939,169 | B2 | 9/2005 | Islam et al. |
| 6,971,912 | B2 | 12/2005 | Montena et al. |
| 7,097,499 | B1 | 8/2006 | Purdy |
| 7,114,990 | B2 | 10/2006 | Bence et al. |
| 7,118,416 | B2 | 10/2006 | Montena et al. |
| 7,252,546 | B1 | 8/2007 | Holland |
| 7,255,598 | B2 | 8/2007 | Montena et al. |
| 7,479,035 | B2 | 1/2009 | Bence et al. |
| 7,507,117 | B2 | 3/2009 | Amidon |
| 7,566,236 | B2 * | 7/2009 | Malloy et al. ..... 439/321 |
| 7,682,177 | B2 * | 3/2010 | Berthet ..... 439/321 |
| 2002/0013088 | A1 | 1/2002 | Rodrigues et al. |
| 2002/0038720 | A1 | 4/2002 | Kai et al. |
| 2003/0214370 | A1 | 11/2003 | Allison et al. |
| 2004/0077215 | A1 | 4/2004 | Palinkas et al. |
| 2004/0102089 | A1 | 5/2004 | Chee |
| 2004/0209516 | A1 | 10/2004 | Burris et al. |
| 2004/0219833 | A1 | 11/2004 | Burris et al. |
| 2004/0229504 | A1 | 11/2004 | Liu |
| 2005/0042919 | A1 | 2/2005 | Montena |
| 2005/0208827 | A1 | 9/2005 | Burris et al. |
| 2006/0110977 | A1 | 5/2006 | Matthews |
| 2008/0102696 | A1 * | 5/2008 | Montena ..... 439/578 |
| 2009/0098770 | A1 | 4/2009 | Bence et al. |

FOREIGN PATENT DOCUMENTS

| | | | |
|---|---|---|---|
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2331634 | A | 5/1999 |
| JP | 3280369 | B2 | 5/2002 |
| WO | 0186756 | A1 | 11/2001 |
| WO | 2004013883 | A2 | 2/2004 |
| WO | 2006081141 | A1 | 8/2006 |

OTHER PUBLICATIONS

Digicon AVL Connector. ARRIS Group Inc. [online]. 3 pages. [retrieved on Apr. 22, 2010]. Retrieved from the Internet:<URL: http://www.arrisi.com/special/digiconAVL.asp>.

U.S. Appl. No. 12/633,792, filed Dec. 8, 2009.

* cited by examiner

CLICK-TIGHT COAXIAL CABLE CONTINUITY CONNECTOR

CROSS-REFERENCE TO RELATED APPLICATIONS

This application claims the priority benefit of U.S. Provisional Patent Application No. 61/179,505 filed May 19, 2009, and entitled CLICK-TIGHT COAXIAL CABLE CONTINUITY CONNECTOR.

FIELD OF THE INVENTION

The present invention relates to F-type connectors used in coaxial cable communication applications, and more specifically to physical and/or audible clicking connector structure extending continuity of an electromagnetic interference shield from the cable and through the connector.

BACKGROUND OF THE INVENTION

Broadband communications have become an increasingly prevalent form of electromagnetic information exchange and coaxial cables are common conduits for transmission of broadband communications. Coaxial cables are typically designed so that an electromagnetic field carrying communications signals exists only in the space between inner and outer coaxial conductors of the cables. This allows coaxial cable runs to be installed next to metal objects without the power losses that occur in other transmission lines, and provides protection of the communications signals from external electromagnetic interference. Connectors for coaxial cables are typically connected onto complementary interface ports to electrically integrate coaxial cables to various electronic devices and cable communication equipment. Connection is often made through rotatable operation of an internally threaded nut of the connector about a corresponding externally threaded interface port. Fully tightening the threaded connection of the coaxial cable connector to the interface port helps to ensure a ground connection between the connector and the corresponding interface port. However, often connectors are not properly tightened or otherwise installed to the interface port and proper electrical mating of the connector with the interface port does not occur. It is not always evident when a standard connector is properly tightened. Moreover, structure of common connectors may permit loss of ground and discontinuity of the electromagnetic shielding that is intended to be extended from the cable, through the connector, and to the corresponding coaxial cable interface port. Hence a need exists for an improved connector having structure that helps to indicate when the connector is properly tightened and helps ensure ground continuity between the coaxial cable, the connector structure, and the coaxial cable connector interface port.

SUMMARY OF THE INVENTION

The invention is directed toward aspects providing a click-tight coaxial cable continuity connector comprising: a connector body, a post engageable with connector body, the post including a flange having a plurality of spaced-apart surface features; a nut, rotatably movable with respect to the post, wherein the nut includes an internal lip having a plurality of spaced-apart surface features, wherein the plurality of spaced-apart surface features of the nut are dimensioned to oppositely correspond in size, number and location to the plurality of spaced-apart surface features of the post; and a click-tight continuity member, structurally configured to operably correspond with the dimensions of the plurality of spaced-apart surface features of the nut and also the spaced apart surface features of the post, the click-tight continuity member residing between the nut and the post; wherein, when the nut is rotated with respect to the post, the click-tight continuity member affords intermittent rotational resistance upon the nut, via structurally-induced compression forces resultant when the plurality of spaced-apart surface features of the nut are not oppositely correspondingly aligned with the plurality of spaced-apart surface features of the post.

The foregoing and other features of construction and operation of the invention will be more readily understood and fully appreciated from the following detailed disclosure, taken in conjunction with accompanying drawings.

DETAILED DESCRIPTION

Figure 1:
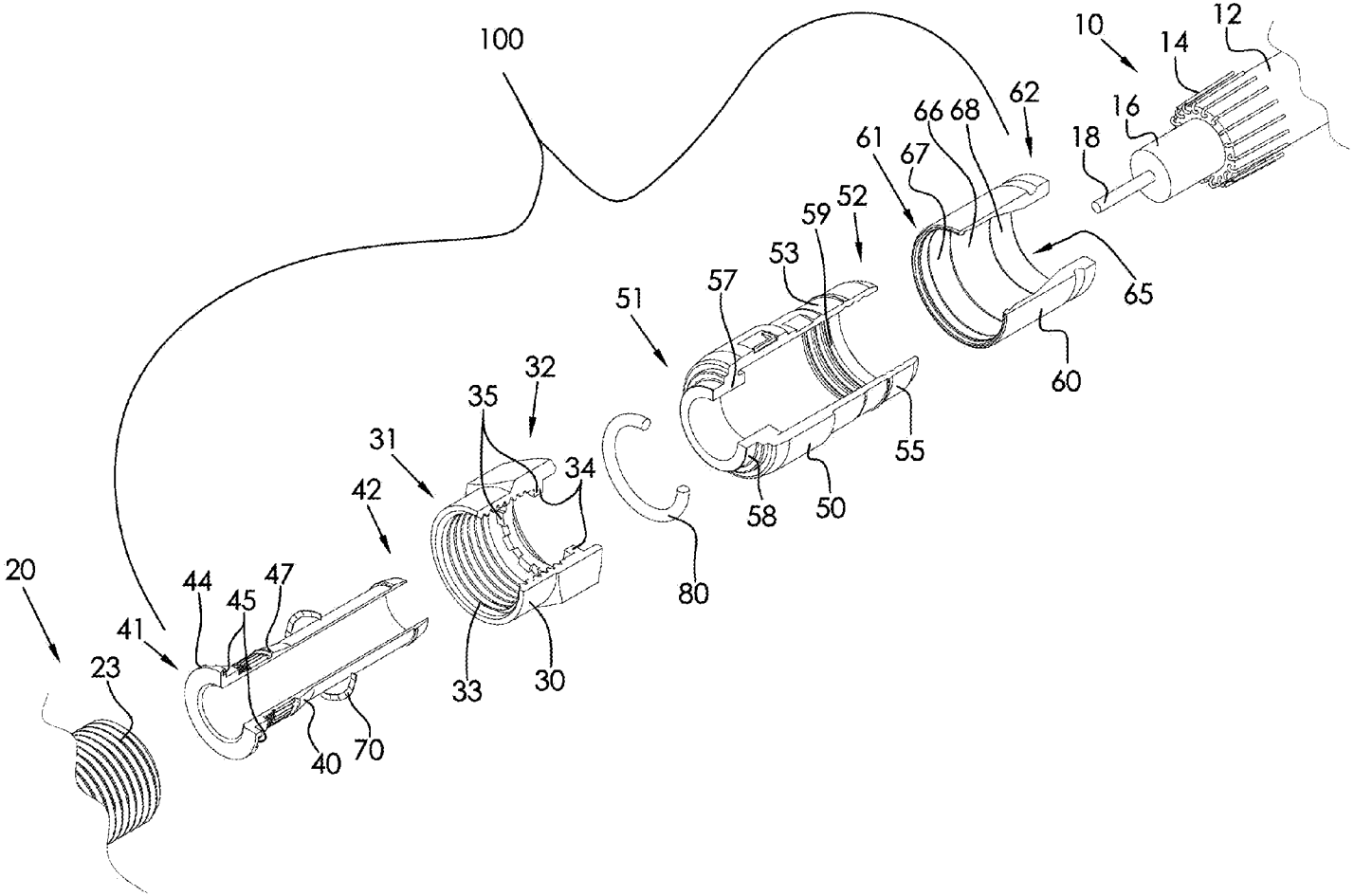
FIG. 1 depicts an exploded perspective view of an embodiment of the elements of an embodiment of a click-tight coaxial cable continuity connector, in accordance with the present invention.

Referring to the drawings, FIG. 1 depicts one embodiment of a click-tight continuity connector 100. The click-tight continuity connector 100 may be operably affixed to a coaxial cable 10 having a protective outer jacket 12, a conductive grounding shield 14, an interior dielectric 16 and a center conductor 18. The coaxial cable 10 may be prepared as embodied in FIG. 1 by removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation. It should be noted that the various materials of which all the various components of the coaxial cable 10 are comprised should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

Referring further to FIG. 1, the connector 100 may also include a coaxial cable interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 23. In addition, the coaxial cable interface port 20 may comprise a mating edge 26 (shown in FIG. 6). It should be recognized that the radial thickness and/or the length of the coaxial cable interface port 20 and/or the conductive receptacle of the port 20 may vary based upon generally recognized parameters corresponding to broadband communication standards and/or equipment. Moreover, the pitch and height of threads which may be formed upon the threaded exterior surface 23 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 operable electrical interface with a connector 100. However, the conductive receptacle 22 should be formed of a conductive material. Further still, it will be understood by those of ordinary skill that the interface port 20 may be embodied by a connective interface component of a coaxial cable communications device, a television, a modem, a computer port, a network receiver, or other communications modifying devices such as a signal splitter, a cable line extender, a cable network module and/or the like.

Referring still further to FIG. 1, an embodiment of a coaxial cable connector 100 may further comprise a threaded nut 30, a post 40, a connector body 50, a fastener member 60, a click-tight continuity member 70, such as, for example, a wave washer or corrugated annular spring formed of conductive material, and a connector body sealing member 80, such as, for example, a body O-ring.

Figure 3:
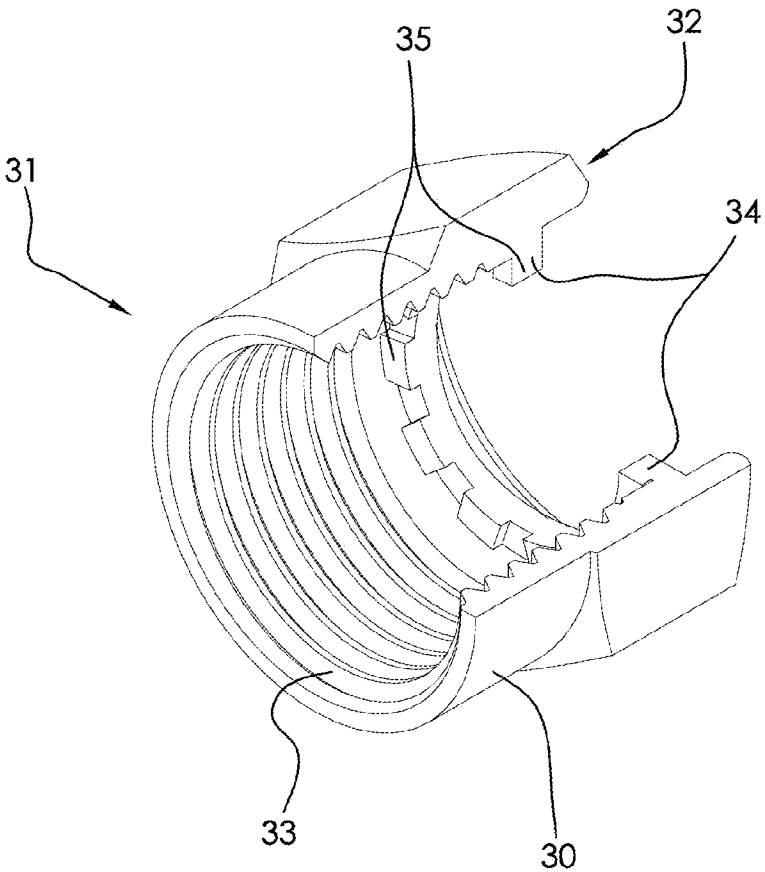
FIG. 3 depicts a side view of a portion of an embodiment of a threaded nut of an embodiment of a click-tight continuity connector, in accordance with the present invention.
Figure 6:
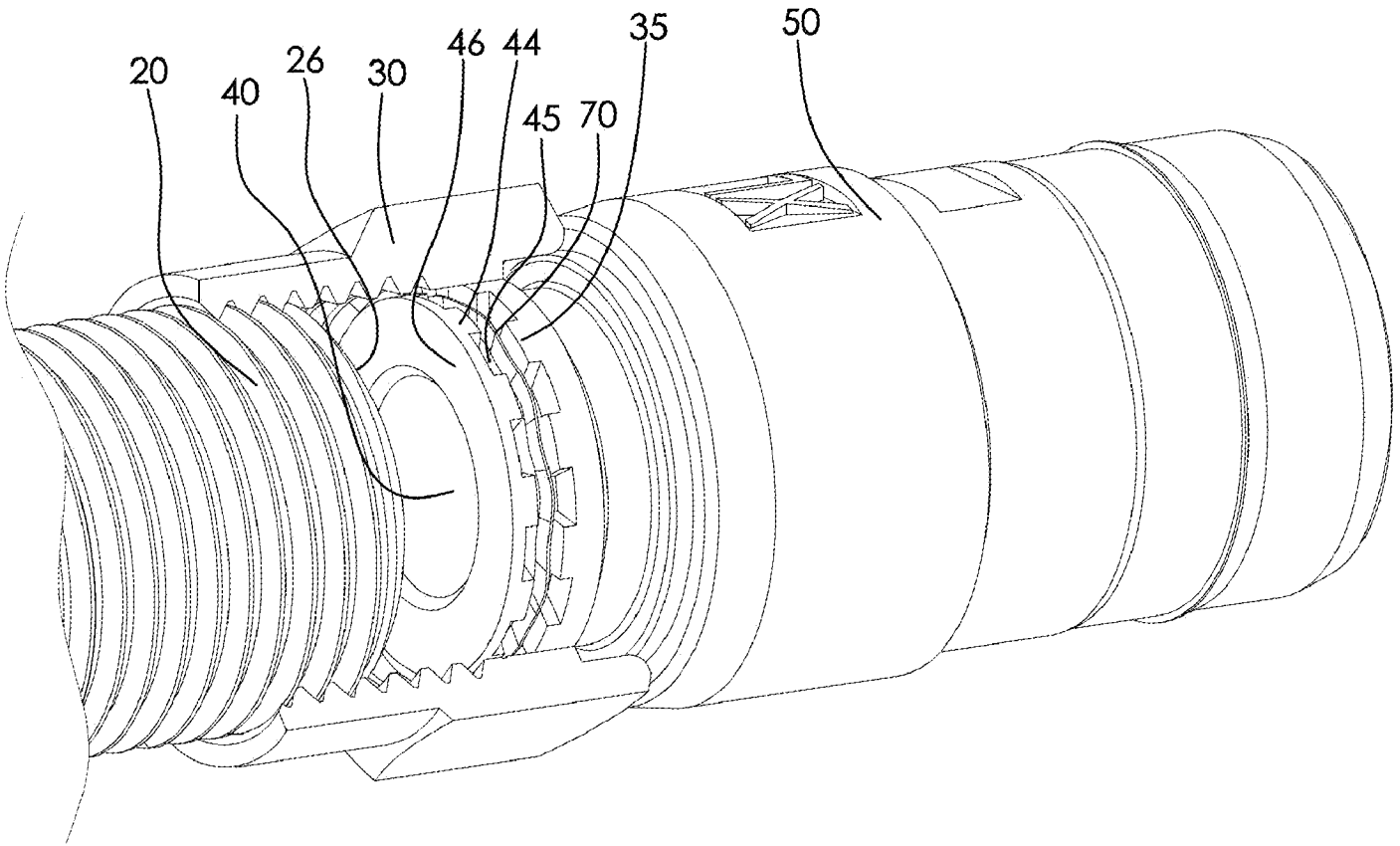
FIG. 6 depicts a rudimentary perspective partial cut-away view of an embodiment of an assembled click-tight continuity connector while being tightened onto an interface port, in accordance with the present invention.
Figure 7:
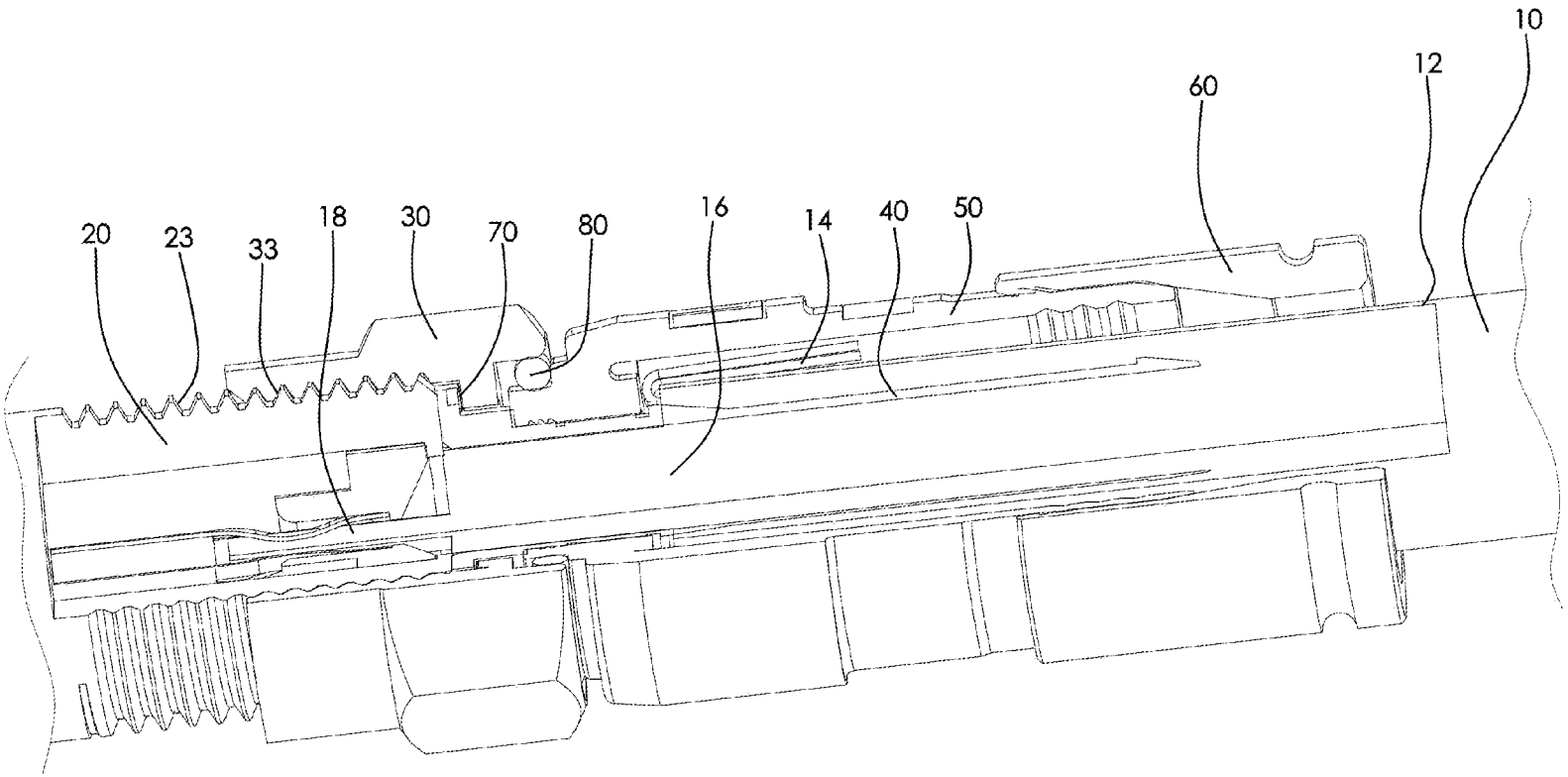
FIG. 7 depicts a perspective cut-away view of an embodiment of a click-tight continuity connector having an attached coaxial cable, the click-tight connector in a fully tightened position on an interface port, in accordance with the present invention.

The threaded nut 30 of embodiments of a click-tight continuity connector 100 is further depicted in FIG. 3. The threaded nut 30 has a first end 31 and opposing second end 32. The threaded nut 30 may comprise internal threading 33 extending axially from the edge of first end 31 a distant sufficient to provide operably effective threadable contact with the external threads 23 of a standard coaxial cable interface port 20 (as shown in FIGS. 1, 6 and 7). The threaded nut 30 may include an internal lip 34, such as an annular protrusion, located proximate the second end 32 of the nut. The internal lip 34 includes a plurality of spaced-apart protrusions 35, such as ribs, juts, bulges, or ridges, extending from the lip 34 toward the first end 31 of the nut 30. The plurality of spaced-apart protrusions 35 may be spaced radially and annularly equidistant from the central axis of the click-tight continuity connector 100. Moreover, the plurality of spaced-apart protrusions 35 may be symmetrically oriented about the central axis of the continuity connector 100. The protrusions 35 may be the result of corresponding depressions or grooves located in the lip 34 of nut 30. Hence, those in the art should appreciate that the protrusions 35 may be any surface feature located internally within the nut 30 to operably interact with the corresponding features of the post 40 and an associated click-tight continuity member 70. The plurality of spaced-apart surface features, such as protrusions 35, of the nut 30 are dimensioned to oppositely correspond in size, number and location to the plurality of spaced-apart surface features, such as depressions 45, of the post 40. The plurality of spaced-apart surface features, such as protrusions 35, on the lip 34 of the nut 30, may in totality form a castellated structural configuration on the side of the lip 34 facing the first end 31. The threaded nut 30 may be formed of conductive materials facilitating grounding through the nut. Accordingly the nut 30 may be configured to extend an electromagnetic buffer by electrically contacting conductive surfaces of an interface port 20 when a connector 100 (shown in FIG. 5) is advanced onto the port 20. In addition, the threaded nut 30 may be formed of both conductive and non-conductive materials. For example the external surface of the nut 30 may be formed of a polymer, while the remainder of the nut 30 may be comprised of a metal or other conductive material. The threaded nut 30 may be formed of metals or polymers or other materials that would facilitate a rigidly formed nut body. Manufacture of the threaded nut 30 may include casting, extruding, cutting, knurling, turning, tapping, drilling, stamping, pressing, injection molding, blow molding, or other fabrication methods that may provide efficient production of the component.

Figure 2:
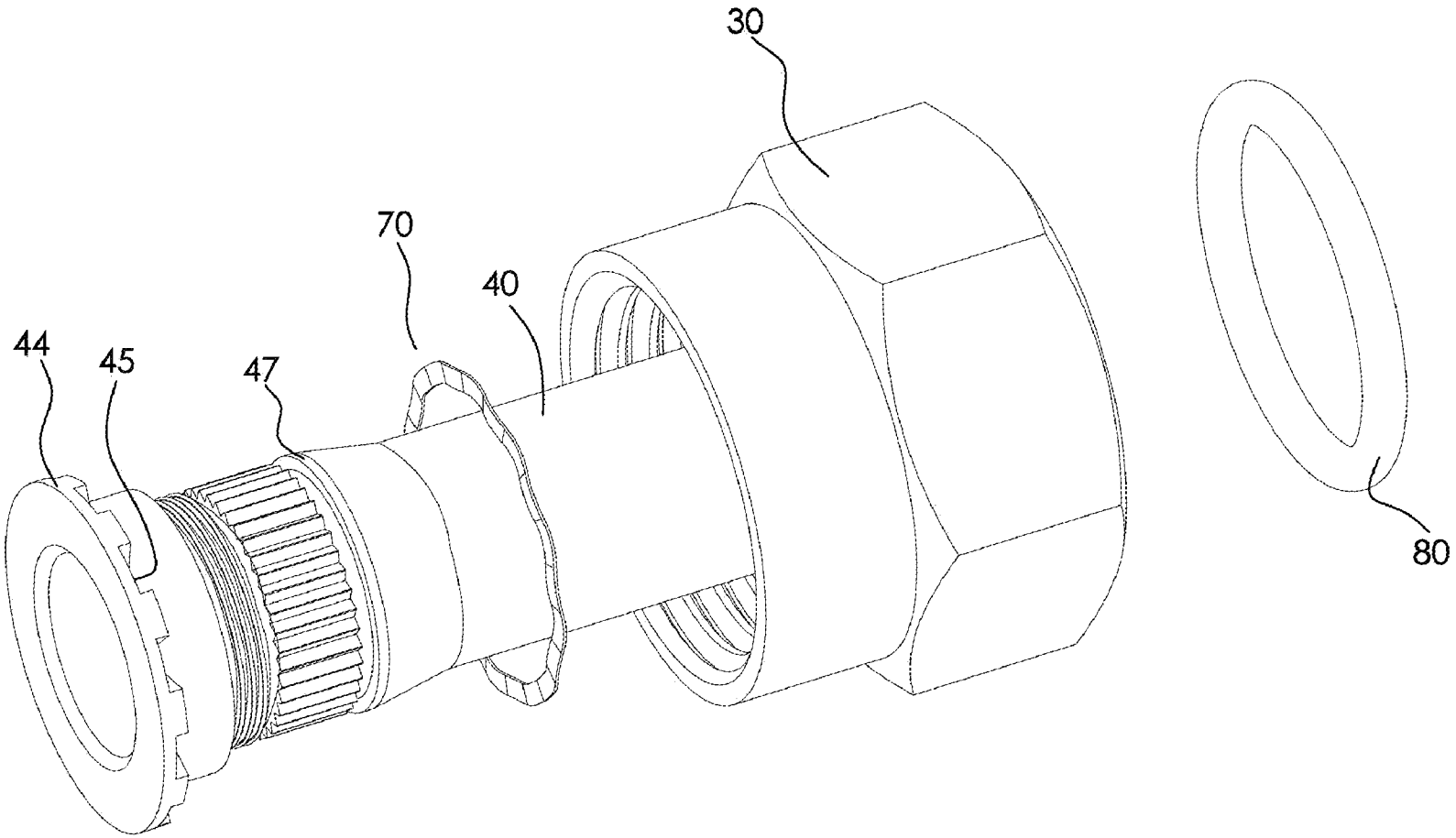
FIG. 2 depicts an exploded perspective view of a portion of an embodiment of a click-tight continuity connector during assembly, in accordance with the present invention.

Referring further to, FIGS. 1-3, an embodiment of a connector 100 may include a post 40. The post 40 comprises a first end 41 and opposing second end 42. Furthermore, the post 40 may comprise a flange 44, such as an externally extending annular protrusion, located at the first end 41 of the post 40. The flange 44 includes a plurality of spaced-apart depressions 45, such as grooves, channels, flutes, slits, cutouts, notches, extending into the flange 44 toward the first end of the post 40 from the side of the flange 44 facing the second end 42 of the post 40. The plurality of spaced-apart depressions 45 may be spaced radially and annularly equidistant from the central axis of the click-tight continuity connector 100. Moreover, the plurality of spaced-apart depressions 45 may be symmetrically oriented about the central axis of the click-tight continuity connector 100. The depressions 45 may be the result of corresponding protrusions, such as ribs, located on the flange 44 of post 40. Hence, those in the art should appreciate that the depressions 45 may be any surface feature located on the flange 44 of the post 40 to operably interact with the corresponding surfaces features of the nut 30 and an associated click-tight continuity member 70. The plurality of spaced-apart surface features, such as depressions 45, on the flange 40 of the post 40, may in totality form a castellated structural configuration on the side of the flange 44 facing the second end 42. The number of, size of, and location of the spaced-apart depressions 45 may oppositely correspond to the number of, size of, and location of the spaced-apart protrusions 35 of the internal lip 34 of threaded nut 30. This structural correspondence may also correspond to the configuration of the click-tight continuity member 70. Further still, an embodiment of the post 40 may include a surface feature 47 such as a lip or protrusion that may engage a portion of a connector body 50 to secure axial movement of the post 40 relative to the connector body 50. Additionally, the post 40 may include a mating edge 46 (shown in FIG. 6). The mating edge 46 may be configured to make physical and electrical contact with a corresponding mating edge 26 of an interface port 20. The post 40 should be formed such that portions of a prepared coaxial cable 10 including the dielectric 16 and center conductor 18 (shown in FIGS. 1 and 7) may pass axially into the second end 42 and/or through a portion of the tube-like body of the post 40. Moreover, the post 40 should be dimensioned such that the post 40 may be inserted into an end of the prepared coaxial cable 10, around the dielectric 16 and under the protective outer jacket 12 and conductive grounding shield 14. Accordingly, where an embodiment of the post 40 may be inserted into an end of the prepared coaxial cable 10 under the drawn back conductive grounding shield 14, substantial physical and/or electrical contact with the shield 14 may be accomplished thereby facilitating grounding through the post 40. The post 40 may be formed of metals or other conductive materials that would facilitate a rigidly formed post body. In addition, the post may be formed of a combination of both conductive and non-conductive materials. For example, a metal coating or layer may be applied to a polymer or other non-conductive material. Manufacture of the post 40 may include casting, extruding, cutting, turning, drilling, stamping, pressing, injection molding, spraying, blow molding, or other fabrication methods that may provide efficient production of the component.

Embodiments of a coaxial cable connector, such as connector 100, may include a connector body 50. The connector body 50 may comprise a first end 51 and opposing second end 52. Moreover, the connector body may include a post mounting portion 57 proximate the first end 51 of the body 50, the post mounting portion 57 configured to mate and achieve purchase with a portion of the outer surface of post 40, so that the connector body 50 is axially secured to the post 40. The post is engageable with the connector body. In addition, the connector body 50 may include an outer annular recess 58 located proximate the first end 51. Furthermore, the connector body may include a semi-rigid, yet compliant outer surface 55, wherein the outer surface 55 may be configured to form an annular seal when the second end 52 is deformably compressed against a received coaxial cable 10 by operation of a fastener member 60. The connector body 50 may include an external annular detent 53 located proximate the second end 52 of the connector body 50. Further still, the connector body 50 may include internal surface features 59, such as annular serrations formed proximate the internal surface of the second end 52 of the connector body 50 and configured to enhance frictional restraint and gripping of an inserted and received coaxial cable 10. The connector body 50 may be formed of materials such as, plastics, polymers, bendable metals or composite materials that facilitate a semi-rigid, yet compliant outer surface 55. Further, the connector body 50 may be formed of conductive or non-conductive materials or a combination thereof. Manufacture of the connector body 50 may include casting, extruding, cutting, turning, drilling, injection molding, spraying, blow molding, or other fabrication methods that may provide efficient production of the component.

With further reference to FIG. 1, embodiments of a coaxial cable connector 100 may include a fastener member 60. The fastener member 60 may have a first end 61 and opposing second end 62. In addition, the fastener member 60 may include an internal annular protrusion 63 located proximate the first end 62 of the fastener member 60 and configured to mate and achieve purchase with the annular detent 53 on the outer surface 55 of connector body 50 (shown in FIGS. 5 and 7). Moreover, the fastener member 60 may comprise a central passageway 65 defined between the first end 61 and second end 62 and extending axially through the fastener member 60. The central passageway 65 may comprise a ramped surface 66 which may be positioned between a first opening or inner bore 67 having a first diameter positioned proximate with the first end 61 of the fastener member 60 and a second opening or inner bore 68 having a second diameter positioned proximate with the second end 62 of the fastener member 60. The ramped surface 66 may act to deformably compress the outer surface 55 of a connector body 50 when the fastener member 60 is operated to secure a coaxial cable 10. Additionally, the fastener member 60 may comprise an exterior surface feature 69 positioned proximate with the second end 62 of the fastener member 60. The surface feature 69 may facilitate gripping of the fastener member 60 during operation of the connector 100. Although the surface feature 69 is shown as an annular detent, it may have various shapes and sizes such as a ridge, notch, protrusion, knurling, or other friction or gripping type arrangements. It should be recognized, by those skilled in the requisite art, that the fastener member 60 may be formed of rigid materials such as metals, hard plastics, polymers, composites and the like. Furthermore, the fastener member 60 may be manufactured via casting, extruding, cutting, turning, drilling, injection molding, spraying, blow molding, or other fabrication methods that may provide efficient production of the component.

Figure 4:
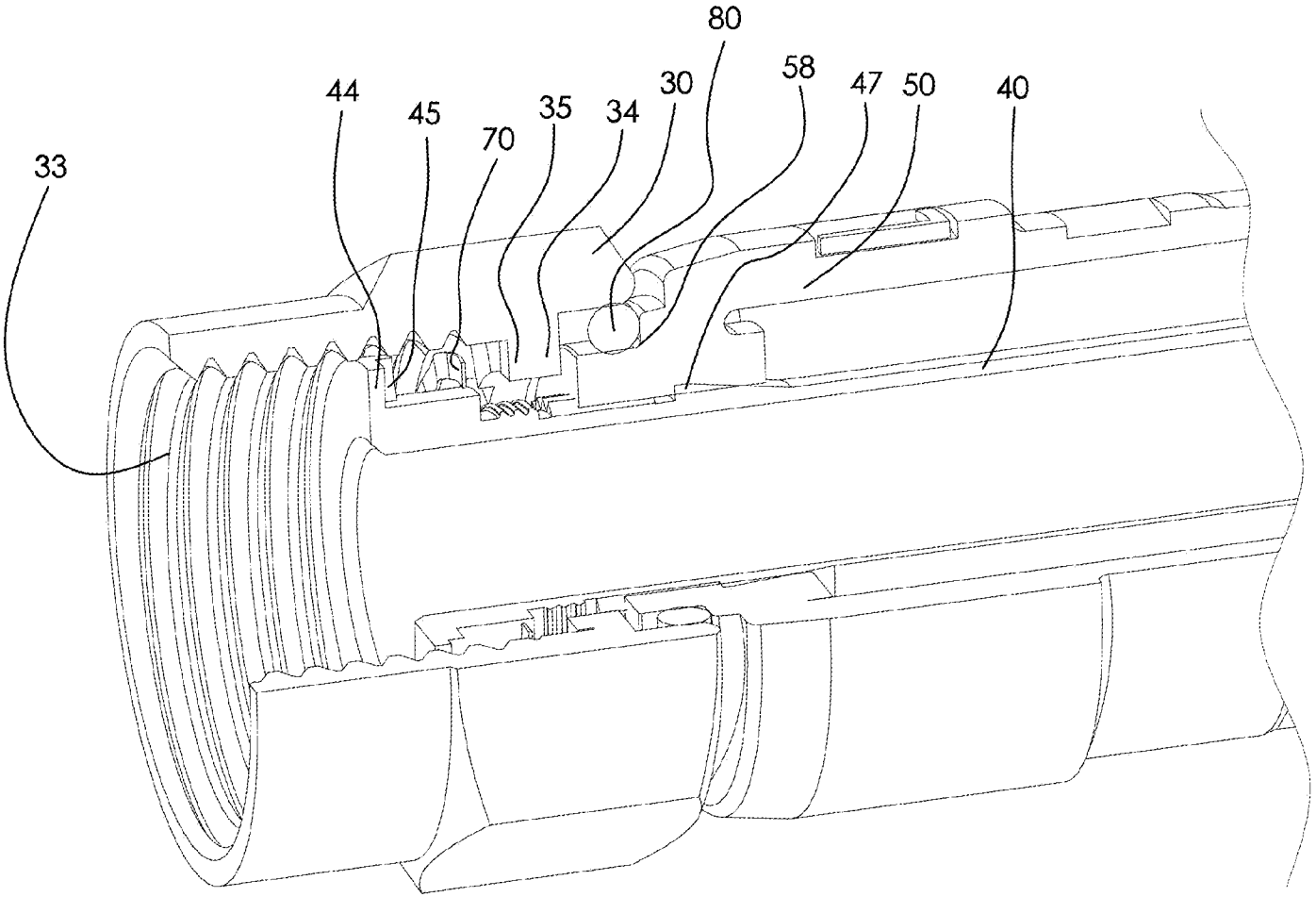
FIG. 4 depicts a perspective cut-away view of an embodiment of click-tight continuity connector during assembly, in accordance with the present invention.
Figure 5:
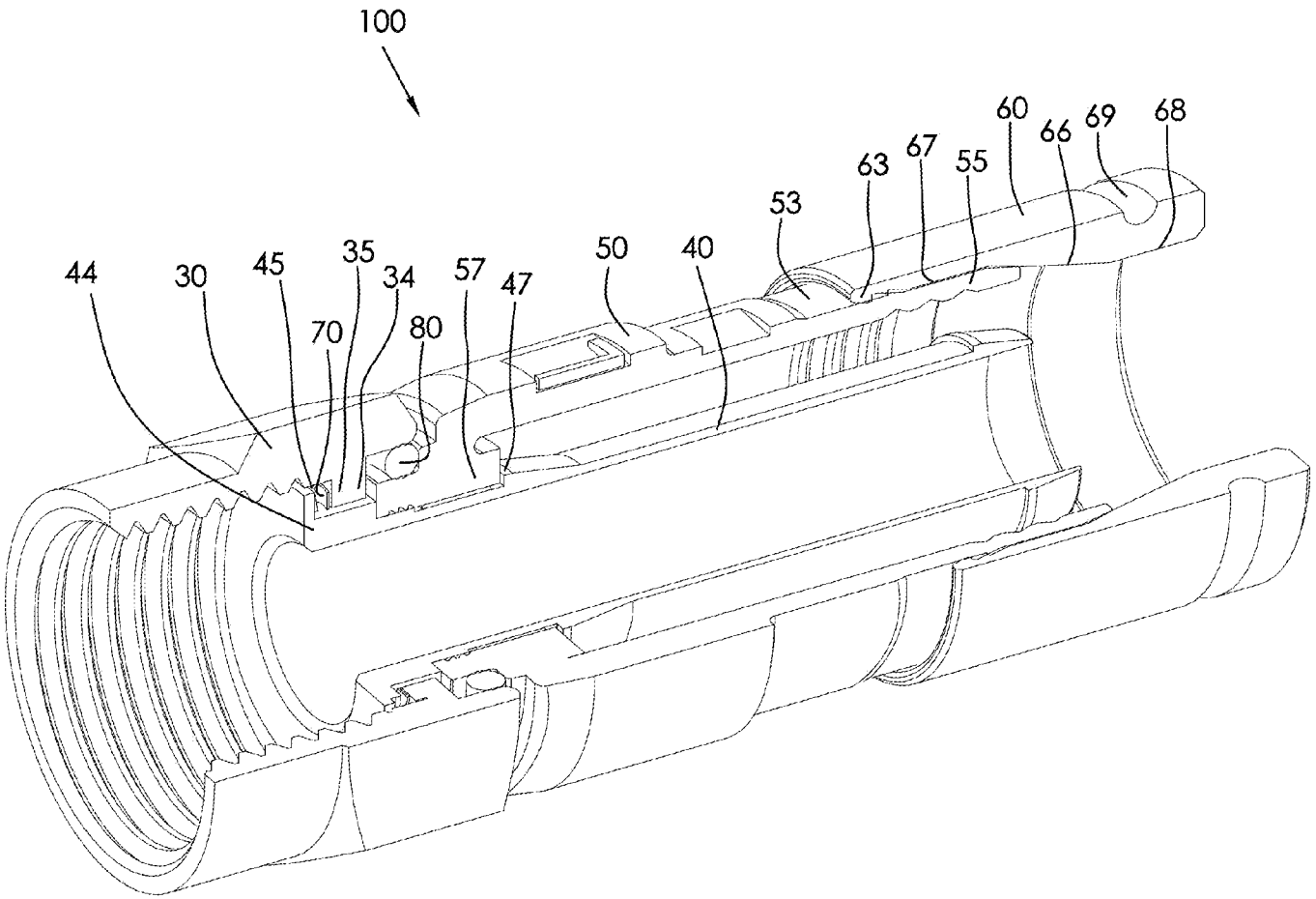
FIG. 5 depicts a perspective cut-away view of an embodiment of an assembled click-tight continuity connector, in accordance with the present invention.

Turning now to FIGS. 2, 4 and 5, an embodiment of a click-tight continuity connector 100 is shown during assembly and as assembled. A click-tight continuity member 70 may be positioned around an external surface of the post 40 during assembly, while the post 40 is axially inserted into position with respect to the nut 30. The click-tight continuity member 70 should have an inner diameter sufficient to allow it to move up the entire length of the post body 40 until it contacts the plurality of depressions 45 of the flange 44 (as depicted also in FIGS. 6-7). The click-tight continuity member 70 is structurally configured to operably correspond with the dimensions of the plurality of spaced-apart surface features, such as protrusions 35, of the nut 30 and also the spaced-apart surface features, such as depressions 45, of the post 40. The click-tight continuity member 70 resides between the nut 30 and the post 40. The body sealing member 80, such as an O-ring, may be located in the second end of the nut 30 in front of the internal lip 34 of the nut, so that the sealing member 80 may compressably reside between the nut 30 and the connector body 50. The body sealing member 80 may fit snugly over the portion of the body 50 corresponding to the annular recess 58 proximate the first end 51 of the body 50. However, those in the art should appreciate that other locations of the sealing member corresponding to other structural configurations of the nut 30 and body 50 may be employed to operably provide a physical seal and barrier to ingress of environmental contaminants.

When assembled, as in FIG. 5, embodiments of a click-tight continuity connector 100 may have axially secured components. For example, the body 50 may obtain a physical interference fit with portions of the post 40, thereby securing those two components together. The flange 44 of the post 40 and the internal lip 34 of the nut 30 may work to restrict axial movement of those two components with respect to each other. Moreover, the configuration of the body 50, as located on the post 40, when assembled, may also restrict axial movement of the nut 30. However, the assembled configuration should not prevent non-tightened rotational movement of the nut 30 with respect to the other click-tight continuity connector 100 components. In addition, when assembled, the fastener member 60 may be secured to a portion of the body 50 so that the fastener member 60 may have some slidable axial freedom with respect to the body 50, thereby permitting operable attachment of a coaxial cable 10. Notably, when embodiments of a click-tight continuity connector 100 are assembled, the click-tight continuity member 70 is disposed between the internal lip of the nut 30 and the flange 44 of the post, so that the continuity member may physically and electrically contact both the nut 30 and the post 40.

With further reference to the drawings, FIG. 6 depicts a rudimentary perspective partial cut-away view of an embodiment of an assembled click-tight continuity connector 100 while being tightened onto an interface port 20. One advantage of the structure of a click-tight continuity connector 100 is that the corresponding surface features of the nut 30 and post 40, such as the plurality of protrusions 35 and the plurality of depressions 45, are structurally configured to afford unique physical interaction between the nut 30, the post 40 and the click-tight continuity member 70 during tightening of the nut 30 onto an interface port 20. This unique physical interaction occurs when the nut 30 rotates with respect to the post 40, as the click-tight continuity member 70 disposed therebetween experiences contact forces depending on the rotational position of the nut 30 with respect to the post and, more particularly, depending on the position of the internal surface features, such as protrusions 35 of the nut, with respect to the oppositely corresponding surface features of the post 40, such as the depressions 45 on the flange 44. The nut 30 is rotatably movable with respect to the post 40, wherein the nut 30 includes an internal lip 34 having a plurality of spaced apart surface features, such as protrusions 35, wherein the plurality of spaced-apart surface features, such as protrusions 35, of the nut 30 are dimensioned to oppositely correspond in size, number and location to the plurality of spaced-apart surface features, such as the depressions 45, of the post 40.

During rotation of the nut 30 with respect to the post 40, the ribbed depressions 45 of the underside of the post flange 44 interface with the corresponding structure of the click-tight continuity member 70, such as a corrugated wave washer. As the mating face 46 of the post 40 begins to contact and compress against the mating face 26 of the interface 20 during tightening, the structural configuration of the nut 30, post 40 and click-tight continuity member 70 creates a locking interface, wherein the click-tight continuity member bends to conform into the oppositely structured spaces between the nut 30 and the post 40. The bending of the click-tight continuity member 70, as the member 70 is contacted by the associated nut 30 and/or post 40 surface features 35, 45, may have an audible sound or "click" and/or a physical "click", such as a catch or other noticeable surge in the tendency to resist rotational movement that an installer may feel during tightening of the click-tight continuity connector 100 onto an interface port 20. This unique "clicking" structure and related functionality is advantageous in that an installer may tighten the click-tight coaxial cable continuity connector 100 onto the interface port 20 until the installer can no longer hear and/or feel the "click." When the nut 30 is rotated with respect to the post 40, the click-tight continuity member 70 affords intermittent rotational resistance upon the nut 30, via structurally-induced compression forces resultant when the plurality of spaced-apart surface features, such as protrusions 35, of the nut 30 are not oppositely correspondingly aligned with the plurality of spaced-apart surface features, such as depressions 45, of the post 40.

The "click" will be no longer resultant during rotational tightening of the nut 30 onto the interface port 20 when the rotational tightening force is no longer sufficient to overcome the bending compression forces evident upon the click-tight continuity member 70 as it conforms to the oppositely alternating interleaved structure of the surface features, such as protrusions 35, of the nut 30 and the surface features, such as the depressions 45, of the post 40. When "clicking" ceases, or when the click-tight continuity connector 100 has obtained a non-click position as a result of tightening onto an interface port 20, the installer may know that the click-tight continuity connector 100 is properly installed on the interface port 20. In a proper non-click position, the nut 30/click-tight continuity member 70/post 40 interface has constant electrical continuity, wherein the associated connector components have an unbroken ground path extending therebetween.

In addition, embodiments of a click-tight coaxial cable continuity connector 100 have structure facilitating a locked tightened position. For instance, once the connector 100 has been tightened to a non-click position, the connector 100 resides in a significantly locked condition on the interface port 20. This is because the connector 100 would not be susceptible to freely loosen, or otherwise have the nut 30 rotate in the reverse untightening direction, since the reverse direction torque required to unlock the properly installed connector 100 is much higher due to the resistive force that would be required to bend and move the click-tight continuity member 70 between and against the interleaved or otherwise partially interlocked surface features, such as the correspondingly oppositely castellated portions 35, 45, of the nut 30 and post 40. Hence, a user must deliberately exert a significant amount of reverse torque to unlock, or otherwise move the nut 30 in a loosening direction.

Turning now to FIG. 7, an embodiment of a click-tight continuity connector 100 having an attached coaxial cable 10 is depicted in a fully tightened position on an interface port 100. As depicted, the click-tight continuity member 70 has been fully compressed between the corresponding surface features, such as the oppositely castellated protrusions 35 and depressions 45, of nut 30 and post 40. With regard to a click-tight continuity member 70 comprising a wave washer, since the click-tight continuity member 70 starts out as having a wave pattern, the corresponding opposite surface features, such as the protruding ribs 35 and depressed grooves 45, force the wave structures of the wave washer continuity member 70 to bend out of and back into a normal wave pattern configuration, as the continuity member 70 is clicked against, or otherwise movably worked, between alternating opposing structural portions 34, 45 of the nut 30 and post 40 during rotation of the nut 30. An advantage of the structural configuration of the click-tight continuity member 70 being shaped to match the corresponding structure of the surface features 35, 45 of the nut 30 and post 40 is that, when the click-tight continuity connector 100 is properly tightened into a non-click, locked position on the interface port 20, the opposing surface features, such as the protrusions 35 of nut 30 and the depressions 45 of post 40, act to provide compression forces on the corresponding structures of the click-tight continuity member 70. For instance, the waves of the wave washer continuity member 70 may be partially compressed between the corresponding surface features 35, 45 of the nut 30 and post 40, such that compressive contact forces are resultant upon the waves of the continuity member 70 positioned therebetween. The compressive contact forces are beneficial in that the forces tend the continuity member 70 toward responsive electrical and physical contact with both the nut 30 and the post 40, thereby ensuring ground continuity between the connector 100 components.

The use of a wave washer click-tight continuity member 70 is beneficial because it allows the use of components typically included in coaxial cable connectors, wherein the components may include structural modifications, which reduces cost of implementing the improvement in production and assembly of click-tight continuity connector embodiments 100. A further benefit of the oppositely structured surface features, such as the spaced-apart protrusions 35 of the nut 30 and the spaced-apart depressions 45 of the post 40, in conjunction with the corresponding matching structure of the click-tight continuity member, may be enhanced moisture sealing when fully tightened, because the connector is more likely to stay properly installed, thereby working to prevent ingress of moisture. One embodiment of a click-tight continuity member 70 is a simple wave washer, as depicted in the drawings. However, those in the art should appreciate that embodiments of the click-tight continuity member 70 may comprise other configurations contemplated to operably correspond with the structure and functionality of the surface features, such as protrusions 35 and depressions 45, of the nut 30 and post 40. Also, any conductively operable material for forming the click-tight continuity member 70 having a suitable resiliency is contemplated, including metal and conductive plastic. Where connector 100 embodiments are provided wherein the continuity member 70 is not conductive, there may still be physical advantages to the resiliency of the member 70 that may facilitate continuity between the post 40 and the nut 30. For instance, the continuity member 70 can help maintain anti-rotational locking and decrease the potential for wiggling and looseness between the associated component parts. Moreover, the axial resilience of the continuity member 70 can improve contact between the port 20 and the post 40. When forces are applied by contact with the corresponding surface features, such as the protrusions 35 and depressions 45 of the nut 30 and post 40, the click-tight continuity member 70 includes corresponding portions that are resilient relative to the longitudinal axis of the click-tight continuity connector 100.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claim(s). The claim(s) provide the scope of the coverage of the invention and should not be limited to the specific examples provided herein.

What is claimed is:

1. A click-tight coaxial cable continuity connector comprising;

a connector body;

a post engageable with connector body, the post including a flange having a plurality of spaced-apart surface features;

a nut, rotatably movable with respect to the post, wherein the nut includes an internal lip having a plurality of spaced-apart surface features, wherein the plurality of spaced-apart surface features of the nut are dimensioned to oppositely correspond in size, number and location to the plurality of spaced-apart surface features of the post; and a click-tight continuity member, structurally configured to operably correspond with the dimensions of the plurality of spaced-apart surface features of the nut and also the spaced apart surface features of the post, the click-tight continuity member residing between the nut and the post;

wherein, when the nut is rotated with respect to the post, the click-tight continuity member affords intermittent rotational resistance upon the nut, via structurally-induced compression forces resultant when the plurality of spaced-apart surface features of the nut are not oppositely correspondingly aligned with the plurality of spaced-apart surface features of the post.

2. The connector of claim 1, wherein continuity member is disposed between the internal lip of the nut and the flange of the post, so that the continuity member physically and electrically contacts both the nut and the post.

3. The connector of claim 1, wherein the continuity member is a corrugated wave washer.

4. The connector of claim 3, wherein, when the nut is rotated with respect to the post, the wave washer bends to conform into the oppositely structured surface features between the lip of the nut and the flange of the post.

5. The connector of claim 4, wherein, the bending of the click-tight continuity member is associated with a physical catch comprising a noticeable surge in the tendency of the nut to resist rotational movement with respect to the post.

6. The connector of claim 4, wherein, the physical catch is associated with an audible click sound.

7. The connector of claim 1, wherein the nut is spaced apart from and does not contact the connector body.

8. The connector of claim 1, further comprising a body sealing member disposed between the nut and the connector body.

9. The connector of claim 1, further comprising a fastener member slidably secured to the connector body, wherein the fastener member includes an internal ramped surface that acts to deformably compress the outer surface the connector body when the fastener member is operated to secure a coaxial cable to the coaxial cable continuity connector.

10. A coaxial cable continuity connector comprising;

a connector body a nut rotatable with respect to the connector body, wherein the nut includes an internal lip having a plurality of spaced-apart surface features;

a post securely engageable with the connector body, wherein the post includes a flange having a plurality of spaced-apart surface features; and a click-tight continuity member residing between the surface features of the lip of the nut and the surface features of the flange of the post, such that when the nut is rotated with respect to the post, the continuity member bends between the surface features of the lip of the nut and the surface features of the flange of the post, wherein, the bending of the continuity member is associated with a physical catch comprising a noticeable surge in the tendency of the nut to resist rotational movement with respect to the post.

11. The connector of claim 10, wherein, the physical catch is associated with an audible click sound.

12. The connector of claim 10, wherein the continuity member is a corrugated wave washer.

13. The connector of claim 10, wherein the the plurality of spaced-apart surface features of the internal lip of the nut are dimensioned to oppositely correspond in size, number and location to the plurality of spaced-apart surface features of the flange of the post.

14. The connector of claim 10, wherein the nut is spaced apart from and does not contact the connector body.

15. The connector of claim 10, further comprising a body sealing member disposed between the nut and the connector body.

16. The connector of claim 10, further comprising a fastener member slidably secured to the connector body, wherein the fastener member includes an internal ramped surface that acts to deformably compress the outer surface the connector body when the fastener member is operated to secure a coaxial cable to the coaxial cable continuity connector.

17. The connector of claim 10, wherein continuity member is disposed between the internal lip of the nut and the flange of the post, so that the continuity member physically and electrically contacts both the nut and the post.

18. A coaxial cable continuity connector comprising:

a post, axially secured to a connector body;

a nut, coaxially rotatable with respect to the post and the connector body, when the coaxial cable continuity connector is assembled; and means for introducing intermittent rotational resistance upon the nut, when the nut is rotated with respect to the post;

wherein the means help maintain anti-rotational locking and decrease the potential for wiggling and looseness between the nut and the post.

19. A method of for introducing intermittent rotational resistance upon the nut of a coaxial cable connector, the method comprising:

providing a coaxial cable continuity connector including:

a connector body;

a post engageable with connector body, wherein the post includes a flange having a plurality of spaced-apart surface features;

a nut, wherein the nut includes an internal lip having a plurality of spaced-apart surface features; and a click-tight continuity member residing between the surface features of the lip of the nut and the surface features of the flange of the post, such that, when the nut is rotated with respect to the post, the continuity member bends between the surface features of the lip of the nut and the surface features of the flange of the post;

rotating the nut with respect to the post so that the continuity member bends, such that the bending of the continuity member affords a physical catch comprising a noticeable surge in the tendency of the nut to resist rotational movement with respect to the post;

further rotating the nut with respect to the post, until the continuity member is located in a position between the post and the nut so that the bending of the continuity member subsides; and still further rotating the nut with respect to the post until the continuity member is again located in a position between the post and the nut, such that renewed bending of the continuity member again affords a physical catch comprising another noticeable surge in the tendency of the nut to resist rotational movement with respect to the post.

20. The method of claim 19, wherein the wherein, the physical catch is associated with an audible click sound.

* * * * *

UNITED STATES PATENT AND TRADEMARK OFFICE

CERTIFICATE OF CORRECTION

PATENT NO. : 7,892,005 B2
APPLICATION NO. : 12/783131
DATED : February 22, 2011
INVENTOR(S) : Richard A. Haube It is certified that error appears in the above-identified patent and that said Letters Patent is hereby corrected as shown below:

in claim 19, column 11, line 28, “of for” should read --of--.
in claim 20, column 12, line 29, “wherein the wherein” should read --wherein the--.

Signed and Sealed this
Nineteenth Day of April, 2011

David J. Kappos

David J. Kappos
*Director of the United States Patent and Trademark Office*